US010238950B2

(12) United States Patent
Kuntz

(10) Patent No.: US 10,238,950 B2
(45) Date of Patent: Mar. 26, 2019

(54) IMPACT ABSORPTION PADDING FOR CONTACT SPORTS HELMETS

(71) Applicant: Carl Kuntz, Waterloo (CA)

(72) Inventor: Carl Kuntz, Waterloo (CA)

( * ) Notice: Subject to any disclaimer, the term of this patent is extended or adjusted under 35 U.S.C. 154(b) by 67 days.

(21) Appl. No.: 15/261,238

(22) Filed: Sep. 9, 2016

(65) Prior Publication Data

US 2017/0232327 A1 Aug. 17, 2017

Related U.S. Application Data

(60) Provisional application No. 62/294,356, filed on Feb. 12, 2016.

(51) Int. Cl.

| | |
|---|---|
| ***A63B 71/10*** | (2006.01) |
| ***A63B 71/08*** | (2006.01) |
| ***A42B 3/06*** | (2006.01) |
| ***A42B 3/12*** | (2006.01) |

(52) U.S. Cl.

CPC ..... *A63B 71/081* (2013.01); *A42B 3/067* (2013.01); *A42B 3/121* (2013.01); *A42B 3/125* (2013.01)

(58) Field of Classification Search

CPC ..... A42B 3/122; A42B 3/121; A42B 3/125; A42B 3/046; A42B 3/124; A42B 3/12; A42B 3/00; A42B 3/06; A42B 3/065; A42B 3/067; A42B 3/128; A42B 3/04; A42B 3/063; A42B 1/08; A63B 71/10; A63B 71/081; A63B 2225/62; A63B 2071/0063; A63B 71/0054; A63B 2220/40; A63B 2220/53; A63B 71/08; A41D 13/0155; A41D 13/015; A41D 31/005; A41D 31/0044; A41D 13/0002; A41D 19/01523

See application file for complete search history.

(56) References Cited

U.S. PATENT DOCUMENTS 2,577,274 A * 12/1951 Sampson ..... A47C 27/081 267/117
2,618,780 A * 11/1952 Cushman ..... A42B 3/122 2/209.7
3,100,498 A * 8/1963 Gibson, Jr. ..... F16K 15/202 137/223
3,208,080 A * 9/1965 Hirsch ..... A42B 3/322 2/414

(Continued)

*Primary Examiner* — Robert H Muromoto, Jr.
(74) *Attorney, Agent, or Firm* — Tai W. Nahm; Miller Thomson LLP

(57) ABSTRACT

There is disclosed an improved impact absorption padding for a contact sports helmet, for contact sports such as football, hockey and lacrosse, which incorporates a plurality of air pockets formed from a resiliently flexible material, such as plastic or rubber. At least some of the air pockets enclose a coil or spring. The coil or spring is also resiliently flexible over a wide range of temperatures, and oriented to compress in the general direction of impact to absorb a substantial portion of the energy before it is transferred to the head of the player. The coil or spring is also sized and shaped to return the air pocket to a desired thickness and shape after an impact. The air pockets may be arranged to substantially cover the outside of a contact sports helmet shell as a layer of impact absorption padding. A second inner layer of impact absorption padding may also be provided inside the contact sports helmet shell.

12 Claims, 7 Drawing Sheets

(56) References Cited

U.S. PATENT DOCUMENTS 3,600,714 A * 8/1971 Cade ..... A42B 3/121 2/413
3,609,764 A * 10/1971 Morgan ..... A42B 3/122 2/414
3,713,640 A * 1/1973 Margan ..... A42B 3/122 2/413
3,729,744 A * 5/1973 Rappleyea ..... A42B 3/127 2/420
3,761,959 A * 10/1973 Dunning ..... A42B 3/122 137/223
3,787,893 A * 1/1974 Larcher ..... A42B 3/062 2/413
3,849,801 A * 11/1974 Holt ..... A42B 3/121 2/413
3,872,511 A * 3/1975 Nichols ..... A42B 3/121 2/413
3,882,547 A * 5/1975 Morgan ..... A42B 3/121 2/414
3,994,020 A * 11/1976 Villari ..... A42B 3/122 2/413
3,994,021 A * 11/1976 Villari ..... A42B 3/125 2/413
3,994,022 A * 11/1976 Villari ..... A42B 3/121 2/413
3,999,220 A * 12/1976 Keltner ..... A42B 3/065 2/23
4,023,213 A * 5/1977 Rovani ..... A42B 3/121 2/413
4,060,855 A * 12/1977 Rappleyea ..... A42B 3/125 2/413
4,068,613 A * 1/1978 Rubey ..... G01P 15/036 116/203
4,125,085 A * 11/1978 Rubey ..... G01P 15/036 116/203
4,177,751 A * 12/1979 Rubey ..... G01P 15/04 116/201
4,237,736 A * 12/1980 Wright ..... G01P 15/04 73/492
4,287,613 A * 9/1981 Schulz ..... A42B 3/145 2/413
4,345,338 A * 8/1982 Frieder, Jr. ..... A42C 2/007 2/414
4,354,284 A * 10/1982 Gooding ..... A42B 3/00 2/413
4,375,108 A * 3/1983 Gooding ..... A42B 3/121 2/413
4,534,068 A * 8/1985 Mitchell ..... A42B 3/124 2/414
4,566,137 A * 1/1986 Gooding ..... A42B 3/122 2/413
4,766,614 A * 8/1988 Cantwell ..... A42B 3/124 2/171.3
5,035,009 A * 7/1991 Wingo, Jr. ..... A42B 3/121 2/414
5,083,320 A * 1/1992 Halstead ..... A42B 3/122 2/413
5,131,174 A * 7/1992 Drew ..... A43B 21/28 36/29
5,175,889 A * 1/1993 Infusino ..... A42B 3/122 2/413
5,181,279 A * 1/1993 Ross ..... A42B 3/122 2/412
5,263,203 A * 11/1993 Kraemer ..... A42B 3/122 2/413
5,274,846 A * 1/1994 Kolsky ..... A41D 13/0156 2/16
5,621,922 A * 4/1997 Rush, III ..... A42B 3/046 2/422
5,890,232 A * 4/1999 Park ..... A42B 3/122 2/413
5,916,664 A * 6/1999 Rudy ..... A41D 31/0044 2/161.1
6,065,159 A * 5/2000 Hirsh ..... A42B 1/08 2/413
6,073,271 A * 6/2000 Alexander ..... A42B 3/122 2/413
6,122,785 A * 9/2000 Bondie ..... A42B 3/121 5/655.3
6,282,724 B1 * 9/2001 Abraham ..... A41D 13/015 2/267
6,530,092 B2 * 3/2003 Pope ..... A42B 3/122 2/413
7,082,623 B2 * 8/2006 Johnson ..... A41D 19/01523 2/413
7,159,249 B2 * 1/2007 Dennis ..... A42B 3/08 2/414
7,299,505 B2 * 11/2007 Dennis ..... A42B 3/12 2/410
7,328,462 B1 * 2/2008 Straus ..... A42B 3/067 2/411
7,478,438 B2 * 1/2009 Lolis ..... A41D 31/0044 2/2.5
8,191,421 B2 * 6/2012 Petelenz ..... F41H 1/02 73/11.01
8,387,552 B2 * 3/2013 Branch ..... G01L 5/0052 116/203
8,524,338 B2 * 9/2013 Anderson ..... A41D 13/015 428/34.1
8,544,117 B2 * 10/2013 Erb ..... A42B 3/122 2/410
8,955,169 B2 * 2/2015 Weber ..... A42B 3/125 2/410
9,056,983 B2 * 6/2015 Nauman ..... C08L 83/00
9,289,023 B2 * 3/2016 Archbold ..... A42B 3/121
9,320,311 B2 * 4/2016 Szalkowski ..... A42B 3/12
9,394,959 B2 * 7/2016 Nauman ..... C08L 83/04
9,408,423 B2 * 8/2016 Guerra ..... A42B 3/064
9,516,910 B2 * 12/2016 Szalkowski ..... F41H 1/08
9,683,622 B2 * 6/2017 Ferrara ..... A41D 13/0155
9,795,178 B2 * 10/2017 Suddaby ..... A42B 3/121
9,833,684 B2 * 12/2017 Warmouth ..... A63B 71/081
2002/0066135 A1 * 6/2002 Tao ..... A42B 3/122 2/411
2005/0217558 A1 * 10/2005 Fitzer ..... G01P 15/036 116/203
2005/0251899 A1 * 11/2005 Dennis ..... A42B 3/12 2/414
2006/0059606 A1 * 3/2006 Ferrara ..... A01N 25/18 2/412
2007/0089480 A1 * 4/2007 Beck ..... A42B 3/046 73/12.01
2007/0209098 A1 * 9/2007 Peart ..... A42B 3/124 2/410
2010/0186154 A1 * 7/2010 Krueger ..... A41D 13/0151 2/459
2011/0144539 A1 * 6/2011 Ouchi ..... A42B 3/046 600/587
2012/0036620 A1 * 2/2012 Harris ..... A42B 3/127 2/414
2012/0198604 A1 * 8/2012 Weber ..... A42B 3/064 2/414
2013/0000017 A1 * 1/2013 Szalkowski ..... A42B 3/127 2/414
2013/0061375 A1 * 3/2013 Bologna ..... A42B 3/127 2/414
2013/0125295 A1 * 5/2013 Krueger ..... A41D 13/0002 2/411
2013/0283506 A1 * 10/2013 Archbold ..... A42B 3/121 2/413
2014/0000011 A1 * 1/2014 Johnson ..... A42B 3/121 2/413
2014/0020158 A1 * 1/2014 Parsons ..... A42B 3/122 2/413
2014/0053968 A1 * 2/2014 Millette ..... A43B 13/203 156/93
2014/0288462 A1 * 9/2014 Pietrantonio ..... A61B 5/4076 600/587

(56) References Cited

U.S. PATENT DOCUMENTS

| | | | | |
|---|---|---|---|---|
| 2015/0075931 | A1* | 3/2015 | Kanous | A47C 27/18<br>188/377 |
| 2016/0331317 | A1* | 11/2016 | Kozloski | A61B 5/6803 |
| 2017/0295881 | A1* | 10/2017 | Martin | A42B 3/122 |

* cited by examiner

IMPACT ABSORPTION PADDING FOR CONTACT SPORTS HELMETS

FIELD OF THE INVENTION

The present invention relates generally to contact sports helmets, and more particularly to improvements in padding for contact sports helmets.

BACKGROUND

Contact sports that involve high-impact hits requires protective equipment to be worn by all players in order to minimize the risk of serious sports injuries. As the consequences of injuries to the head of contact sports players can be particularly serious, leading to concussions and possibly even chronic conditions, protecting contact sports players from repeated hard impacts to the head must be a top priority. However, many existing designs for padding for contact sports helmets suffer from a limited ability to absorb hard impacts. What is needed is an improved padding for a contact sports helmet which addresses at least some of the limitations in the prior art.

SUMMARY

The present invention relates to an improved impact absorption padding for a contact sports helmet, for use in various contact sports such as football, hockey and lacrosse, which incorporates a plurality of air pockets formed from a resiliently flexible material, such as plastic or rubber. At least some of the air pockets enclose a resiliently flexible impact absorption member, such as coil or spring.

In an alternative embodiment, the resiliently flexible impact absorption members are a plurality of resiliently flexible ribs that are positioned around the walls of an air pocket. The ribs are generally vertically oriented, and may increase in cross-section from top to bottom in order to compress and absorb a progressively increasing impact force.

The resiliently flexible impact absorption members are resiliently flexible over a wide range of temperatures, and oriented to compress in the general direction of impact to absorb a substantial portion of the energy before it is transferred to the head of the player. The resiliently flexible impact absorption members also sized, shaped and configured to return the air pocket to a desired thickness and shape after an impact.

In an embodiment, the air pockets are arranged in an array or grid, and the resiliently flexible impact absorption members are provided in different patterns in at least some of the air pockets, or all of them. The air pockets may be arranged to substantially cover the outside of a contact sports helmet shell as a layer of impact absorption padding.

In another embodiment, each air pocket may include a pressure control valve which is adapted to allow air to escape from the air pocket at a controlled rate. This controlled rate is set to allow the air pocket to absorb impacts without deflating too quickly, and to maximize the impact absorption potential. After compression, the resiliently flexible impact absorption members return the air pockets to their original position.

Adjacent air pockets that do not contain resiliently flexible impact absorption members may also include a pressure control valve which allows air to escape at a different rate from the air pockets containing resiliently flexible impact absorption members, thereby providing at least two different impact absorption mechanisms.

In another embodiment, air pockets that do not contain resiliently flexible impact absorption members may be completely sealed, such that the sealed air pockets maintain a relatively constant amount of air at all times. However, as the sealed air pockets are formed from a resiliently flexible material, the walls of the sealed air pockets may be at least partially displaced into adjacent air pockets including resiliently flexible impact absorption members, thereby maximizing impact absorption potential.

In another embodiment, the air pockets may be formed from various thicknesses of plastic and rubber forming different parts of the air pocket. The walls between adjacent air pockets may be formed of a thinner, more flexible material, allowing each air pocket to expand more easily into adjacent air pockets if compressed by an impact force.

In another embodiment, an air pocket may include a plurality of resiliently flexible ribs spaced around the around the wall of the air pocket. The resiliently flexible ribs are preferably vertically oriented, and increase in cross-section from top to bottom, such that the resiliently flexible ribs can progressively absorb an increasing impact force as the air pocket compresses. These ribs may be in lieu of, or in addition to the springs as described earlier.

In another embodiment, a layer of outer skin may be a silicone-like skin that is firmly bonded to the top of the layer of air pockets. This outer layer may receive paints or decals depicting team colors and logos on the contact sports helmet.

In another embodiment, a second layer of impact absorption padding may be placed inside a contact sports helmet to replace any conventional padding material provided inside a contact sports helmet shell. Similar to the layer of outer impact absorption padding, the layer of inner impact absorption padding may also be formed from an array or grid of air pockets, at least some of, or all of which may include a coil or spring. These air pockets may form an inner impact absorption layer with the air pockets sized and shaped to comfortably surround the head of a contact sports player. Conventional foam padding may be used to supplement the inner impact absorption padding to fill in any gaps.

In this respect, before explaining at least one embodiment of the invention in detail, it is to be understood that the invention is not limited in its applications to the details of construction and to the arrangements of the components set forth in the following description or the examples provided therein, or illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION

As noted above, the present invention relates to an improved impact absorption padding for a contact sports helmet, for use in contact sports such as football, hockey and lacrosse.

Figure 1:
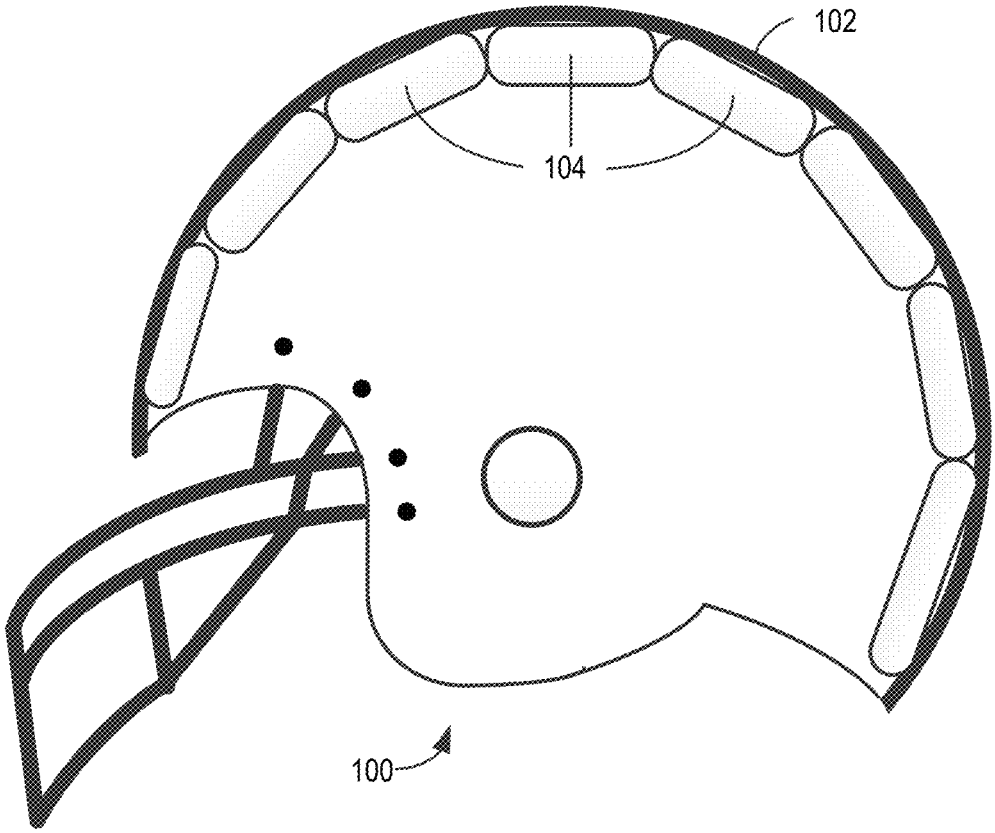
FIG. 1 (Prior Art)
FIG. 1 shows a cross-section of a contact sports helmet, in this example a football helmet, in accordance with the prior art in which a hard plastic shell forms the outer layer, and foam padding is arranged inside in various configurations.

As illustrated in FIG. 1, shown is a cross-section of a contact sports helmet 100, in this example a football helmet, in accordance with the prior art in which a hard plastic shell 102 forms the outer layer, and foam padding 104 is arranged inside in various configurations. This conventional football helmet design can transfer a significant amount of impact force to the head of a football player, as there is a lack of impact absorption material that will collapse or compress sufficiently to absorb an impact.

Figure 2:
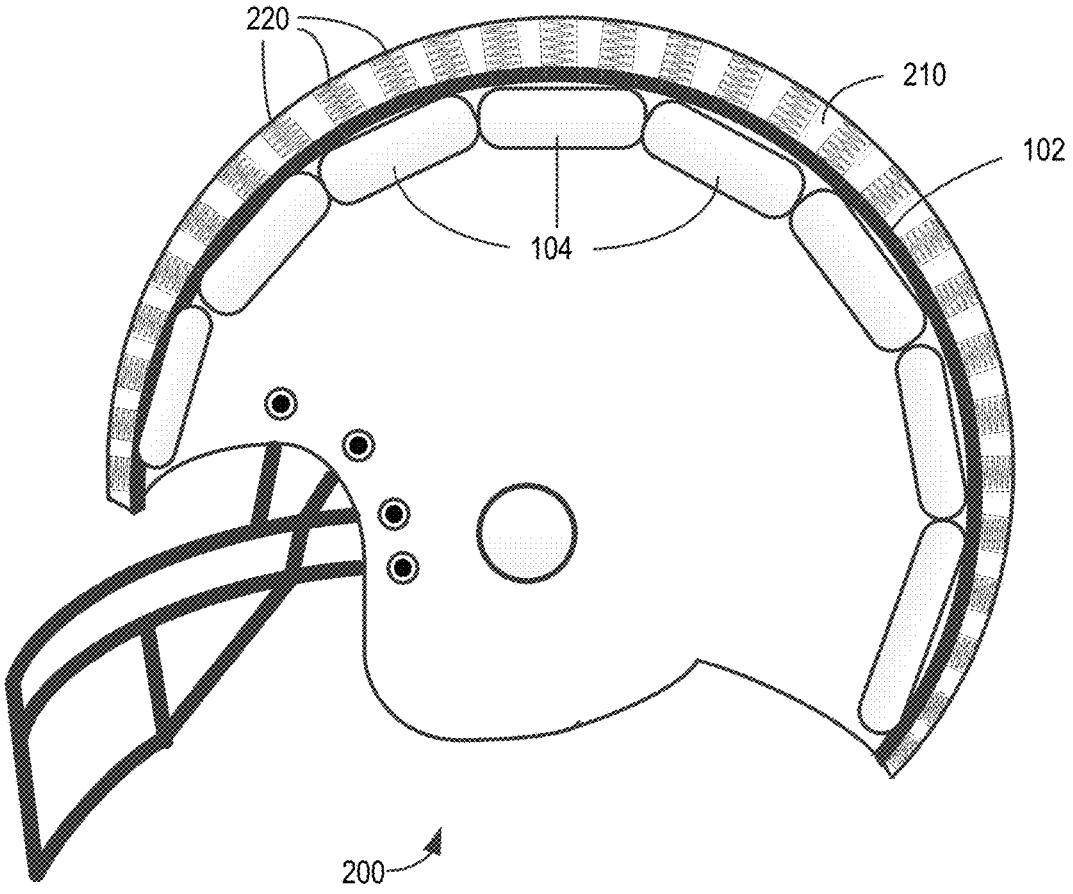
FIG. 2 shows a cross-section of a contact sports helmet, in this example a football helmet, in accordance with an embodiment in which a layer of impact absorption padding is formed outside of the hard plastic shell of FIG. 1.

FIG. 2 shows a cross-section of a contact sports helmet 200, in this example a football helmet, in accordance with an embodiment of the present invention, in which a layer of padding 210 is formed outside of the hard plastic shell 102 of FIG. 1. In an embodiment, the impact absorption padding incorporates a plurality of air pockets 220 formed from a resiliently flexible material, such as plastic or rubber. At least some of the air pockets 220 enclose a resiliently flexible impact absorption member, such as a coil or spring. The resiliently flexible impact absorption member is resiliently flexible over a wide range of temperatures, and oriented to compress in the direction of impact to absorb a substantial amount of the energy of an impact. The resiliently flexible impact absorption member is also sized and shaped to return the air pocket in which it is housed to a desired thickness and shape after an impact.

Figure 3:
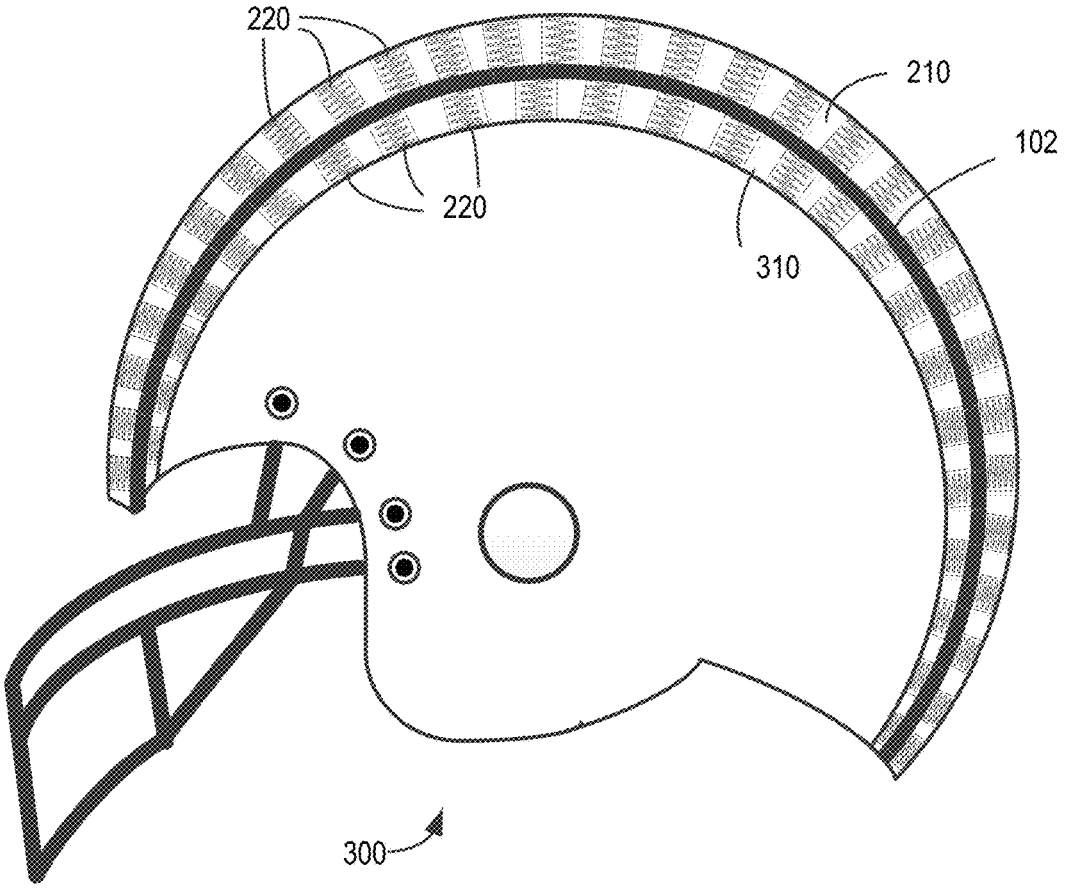
FIG. 3 shows a cross-section of a contact sports helmet, in this example a football helmet, in accordance with another embodiment in which a layer of impact absorption padding is formed both outside of the hard plastic shell, and inside of the hard plastic shell.

FIG. 3 shows a cross-section of a contact sports helmet 300, in this example a football helmet, in accordance with another embodiment in which layers of impact absorption padding 210, 310 are formed both outside of the hard plastic shell 102, and inside of the hard plastic shell. This second inner layer 310 of impact absorption padding may be securely attached to the inside of the football helmet shell 102 to replace any conventional padding material. Similar to the outer layer of impact absorption padding 210, the inner layer of impact absorption padding 310 may also be formed from an array or grid of air pockets 220, at least some or all of which may include a resiliently flexible impact absorption member, such as a coil or spring. These air pockets 220 may be sized and shaped to comfortably surround the head of a football player. Thin foam pads (not shown) may be used to line the air pockets for additional comfort and to fill in any gaps. Some through holes may be placed in between air pockets to allow for adequate ventilation in warm conditions.

Figure 4:
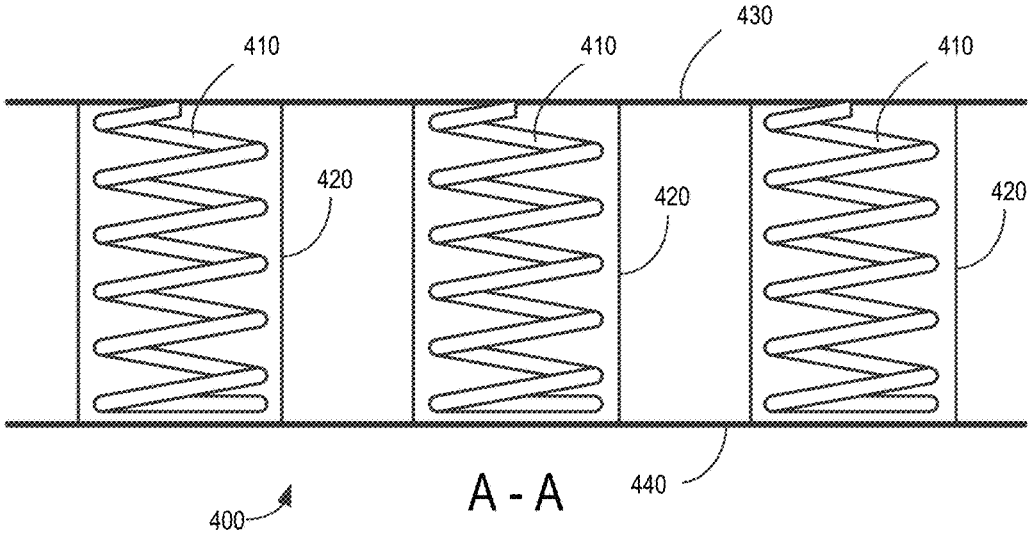
FIG. 4 shows a partial cross-sectional view of a layer of padding in accordance with an embodiment, in which a number of individual coils or springs are encased within an air pocket or cell.

FIG. 4 shows a partial cross-sectional view of a layer of padding 400 in accordance with an embodiment, in which a number of individual coils or springs 410 are encased within an air pocket or cell 420. The air pockets 420 may be formed from various thicknesses of plastic and rubber forming different parts of the air pocket. For example, the top layer 430 forming the outer surface may be relatively thick, to provide some structure and strength to the array or grid. The walls between adjacent air pockets 420 may be formed of a thinner, more flexible material, allowing each air pocket to expand more easily into adjacent air pockets if compressed by an impact force.

Figure 5:
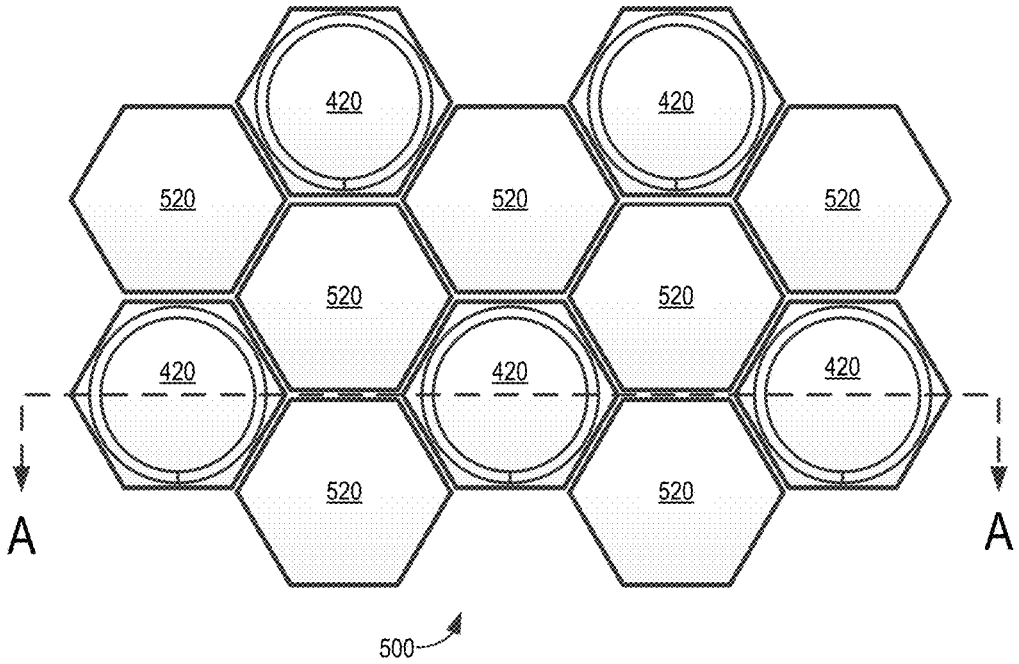
FIG. 5 shows a schematic view of an arrangement of air pockets in accordance with an illustrative embodiment, some of which air pockets include individual coils or springs.

FIG. 5 shows a schematic view of an arrangement 500 of air pockets 420, 520 in accordance with an illustrative embodiment, some of which air pockets 420 include resiliently flexible impact absorption member, such as individual coils or springs. Other air pockets 520 may not include such individual coils or springs. As shown in FIG. 5, the air pockets 420, 520 are arranged in an array or grid, bonded to a base layer 440 of harder plastic. The base layer 440 may be a molded plastic layer adapted to the shape of a contact sports helmet shell. The resiliently flexible impact absorption members are provided in different patterns in at least some of the air pockets 420, or all of them. This impact absorption layer 400 of air pockets 420, 520 may be arranged to substantially cover the outside of a football helmet shell 102, and attached to the helmet shell 102 using secure, removable fasteners.

Figure 6:
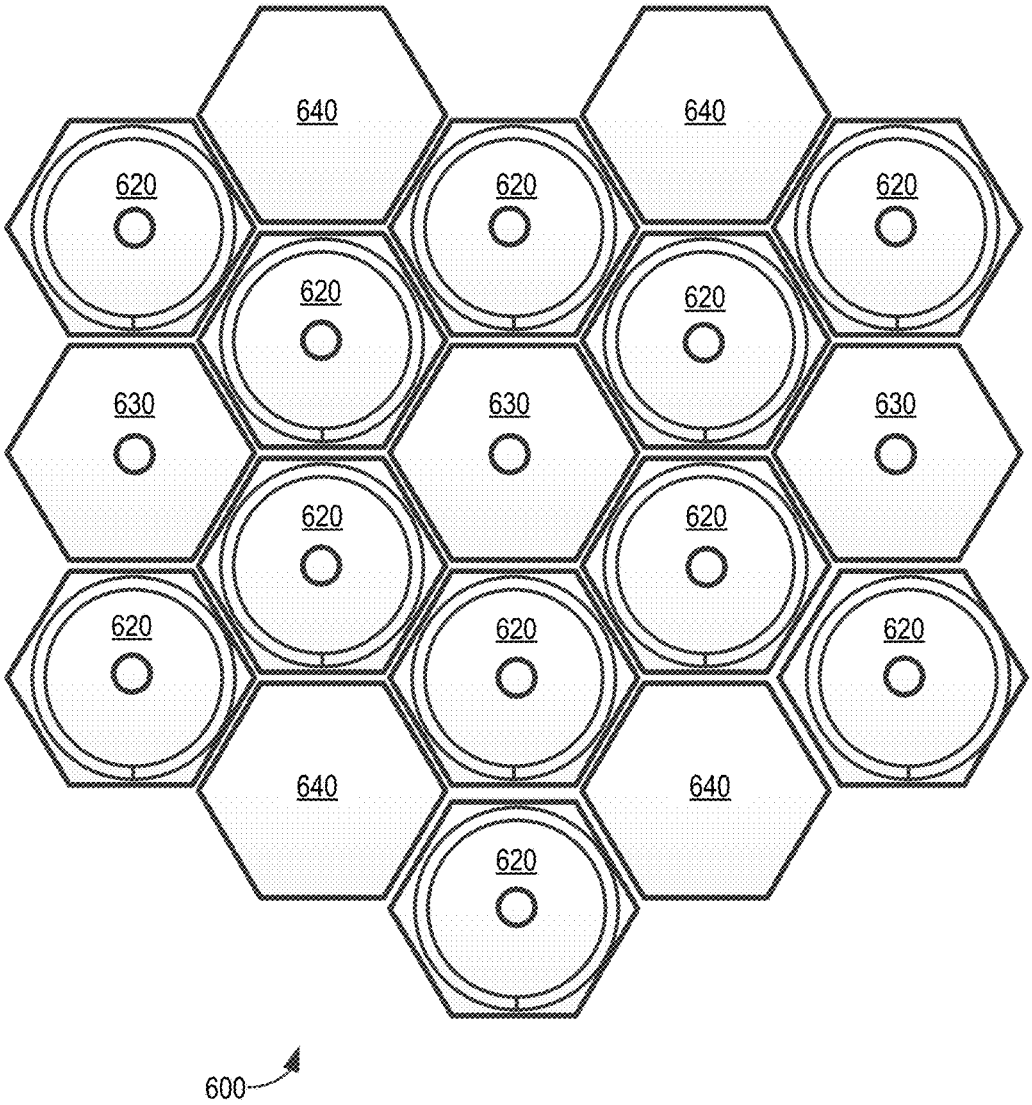
FIG. 6 shows another schematic view of an arrangement of air pockets, some of which air pockets include individual coils or springs.

As shown in FIG. 6, in an embodiment 600, some air pockets 620 may include a pressure control valve 622 which allows air to escape from the air pocket at a controlled rate. The controlled rate is set to allow the air pocket 620 to absorb impacts without deflating too quickly. After compression, the resiliently flexible impact absorption member (i.e. coil or spring) returns the air pocket 620 to its original position.

Adjacent air pockets 630 that do not contain resiliently flexible impact absorption members (i.e. coils or springs) may also include a pressure control valve 622 which allows air to escape at a different rate from the air pockets 620 containing a resiliently flexible impact absorption member (i.e. coil or spring), thereby providing at least two different adjacent air pockets 620, 630 with different impact absorption characteristics. The pressure control valves 622 also allow air back into the air pocket 620 when the coil or spring restores the air pocket 620 to its original shape and volume.

Advantageously, a severe impact to the contact sports helmet can be substantially absorbed by the impact absorption layer 210, 310, 400, 500, 600, before most of the energy is transferred to the contact sports player's head.

Still referring to FIG. 6, some of the air pockets 640 that do not contain springs or coils may be completely sealed without pressure control valves, such that such air pockets 640 contain a relatively constant amount of air at all times. However, as the air pockets 640 are formed from a resiliently flexible material, the volume of air may be at least partially displaced into adjacent air pockets 620 including springs or coils.

Figure 7:
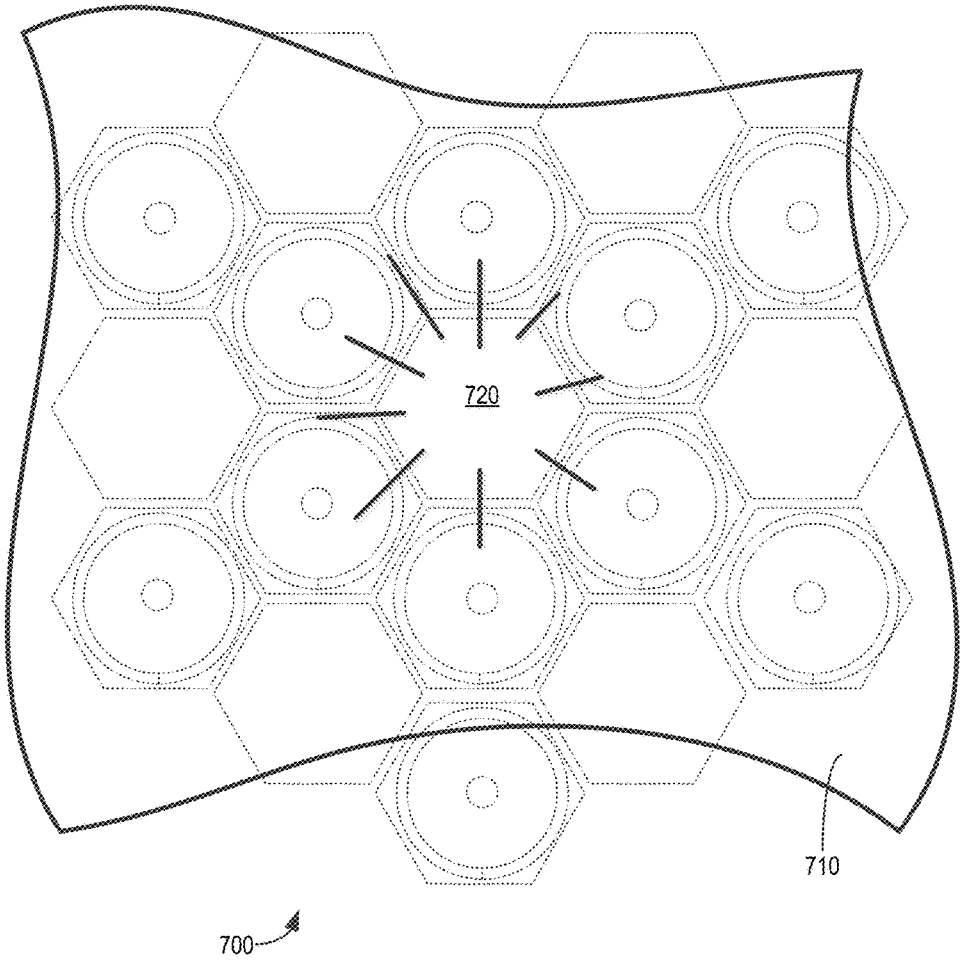
FIG. 7 shows another schematic view of an optional outer skin adapted to be non-resilient when the impact force exceeds a certain predetermined threshold.

FIG. 7 shows another schematic view 700 of an optional outer skin 710 adapted to be non-resilient when the impact force exceeds a certain predetermined threshold. This outer skin 710 may be adapted to show the extent and severity of an impact to the helmet which has exceed a threshold, by visual markings at the area of impact 720, such as by a deformation of the outer skin indicated by depressions and other visual cues. This allows the player or team doctor to test the player for possible concussion, and depending on severity, put the player into concussion protocol. This marking 720 of a severe impact on the outer skin 710 can also provide a cue to replace the outer layer of impact absorption padding 210, 400, 500, 600.

In an embodiment, this outer skin 710 may be a silicone-like skin that is firmly bonded to the top of the layer of air pockets 620, 630, 640. This outer layer 710 may receive paints or decals depicting team colors and logos on the football helmet.

Figure 8:
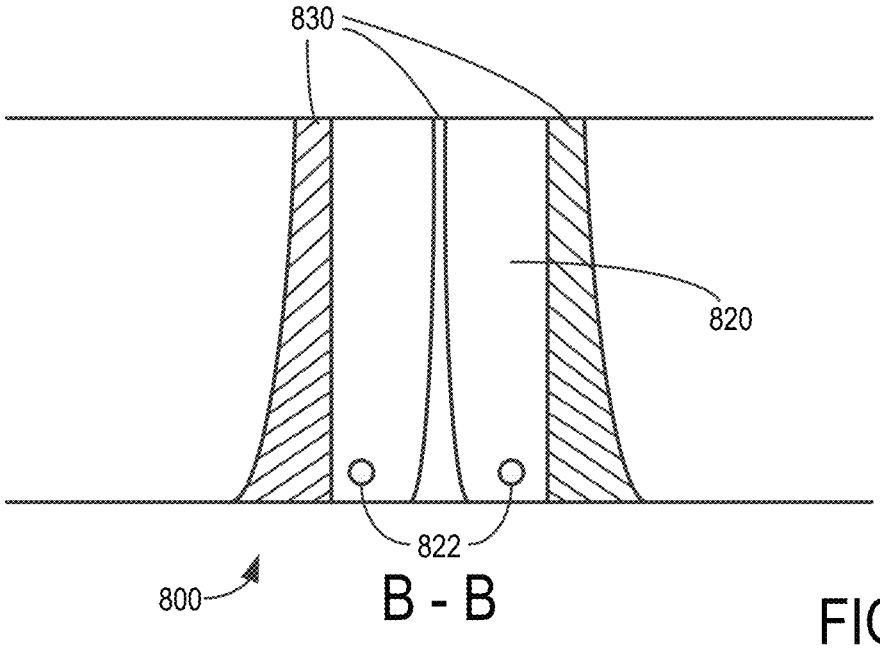
FIG. 8 shows a cross-sectional view of a layer of padding in accordance with another embodiment, in which each air pocket or cell includes a plurality of ribs positioned around the air pocket or cell.
Figure 9:
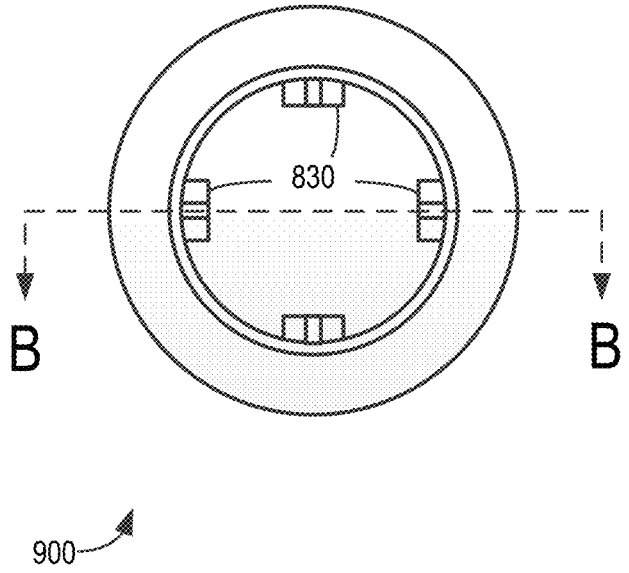
FIG. 9 shows a corresponding top view of the embodiment of FIG. 8.

Now referring to FIG. 8, shown is a cross-sectional view of a layer of padding 800 in accordance with another embodiment, in which each air pocket or cell 820 includes a plurality of resiliently flexible ribs 830 positioned around the wall of air pocket or cell. FIG. 9 shows a corresponding top view 900 of the embodiment of FIG. 8. In this embodiment, the plurality of ribs 830 are generally vertically oriented, and are shaped so as to provide a progressively increasing cross-section or thickness from the top of the ribs 830 to the bottom (see FIG. 8). This progressively increasing cross-section allows the air pocket 820 of FIGS. 8 and 9 to compress in the direction of impact to absorb a progressively increasing impact force. The amount of impact force that the ribs 820 can absorb may be varied by the number of ribs 830 spaced around the air pocket or cell 820, and the cross-section of the ribs 830 as they progressively increase from top to bottom.

In an embodiment, the plurality of ribs 830 in the embodiment of FIGS. 8 and 9 are of a resiliently flexible plastic or rubber material, and are adapted to return to their original shape after absorbing an impact force.

In another embodiment, the air pocket or cell 820 of FIGS. 8 and 9 is provided with pressure control valve 822 adapted to control the rate at which air escapes from an air pocket 820. In this embodiment, the pressure control valve 822 is adapted to allow air to escape to an adjacent air pocket rather than to the ambient air in the environment.

While illustrative embodiments have been described above by way of example with respect to a football helmet, it will be appreciated that the impact absorption padding as described above may be applied to other contact sports helmets, such as hockey helmets and lacrosse helmets, for example. Any contact sport in which players repeatedly come into hard contact and wear helmets for head protection may benefit from the impact absorption padding as described above.

Thus, in an aspect, there is provided an impact absorption padding for a contact sports helmet, comprising: a plurality of air pockets configured in an array and adapted to attach to a contact sports helmet shell; and a resiliently flexible impact absorption member provided in at least some of the plurality of air pockets, the resiliently flexible impact absorption member oriented and adapted to compress in the direction of an impact and absorb a substantial portion of the impact force.

In an embodiment, the air pockets may be formed from various thicknesses of plastic and rubber forming different parts of the air pocket.

In another embodiment, the resiliently flexible impact absorption member comprises a coil or spring.

In another embodiment, the resiliently flexible impact absorption member comprises a plurality of resiliently flexible ribs spaced around the around the wall of the air pocket.

In another embodiment, the plurality of resiliently flexible ribs are vertically oriented, and increase in cross-section from top to bottom.

In another embodiment, at least some of the plurality of air pockets include a pressure control valve, the pressure control valve adapted to control the rate at which air escapes from an air pocket.

In another embodiment, the pressure control valve is adapted to allow air to escape externally to a surrounding environment.

In another embodiment, the pressure control valve is adapted to allow air to escape to an adjacent air pocket.

In another embodiment, at least some of the air pockets include a pressure control valve adapted to allow air to escape at a different rate from other adjacent air pockets, thereby providing at least two different types of air pockets with different impact absorption mechanisms.

In another embodiment, at least some of the air pockets are sealed air pockets which do not include a pressure control valve, but are formed from a resiliently flexible material adapted to allow the walls of the sealed air pocket to be at least partially displaced into adjacent air pockets.

In another embodiment, the impact absorption padding further comprises a layer of outer skin bonded to the top of the plurality of air pockets.

In an embodiment, the outer skin is a silicon material adapted to mark an area of impact that has exceeded a threshold.

In another embodiment, the mark is a deformation of the outer skin indicated by depressions and other visual cues.

In another embodiment, the outer skin is adapted to receive paints or decals depicting team colors and logos.

In another embodiment, the impact absorption padding further comprises a base layer for providing structural support for the plurality of air pockets.

In an embodiment, the base layer is a molded plastic layer adapted to the shape of a contact sports helmet shell.

In another embodiment, the plurality of air pockets configured in an array are arranged in a repeating pattern of different types of air pockets, including alternating air pockets with resiliently flexible impact absorption members and pressure control valves with adjacent sealed air pockets without air pressure control valves.

In another embodiment, the padding is adapted to be placed on an inside of a contact sports helmet shell as an inner impact absorption padding.

In another embodiment, the padding adapted to be placed on an inside of a contact sports helmet shell as an inner impact absorption padding is further adapted to receive foam padding to supplement the inner impact absorption padding.

In another embodiment, the contact sport is one of football, hockey and lacrosse.

Various changes and modifications may be made without departing from the scope of the invention, which is defined by the following claims.

The invention claimed is:

1. An impact absorption padding for a contact sports helmet, comprising:

a plurality of air pockets configured in an array and adapted to attach externally to a contact sports helmet shell, each of the plurality of air pockets including a pressure control valve vented directly to a surrounding ambient air in the environment, each pressure control valve adapted to control the rate at which air escapes from an air pocket to the surrounding environment; and a plurality of resiliently flexible ribs positioned around a wall of each air pocket and shaped to provide a progressively increasing cross-section from a top of the ribs to a bottom of the ribs, the resiliently flexible ribs oriented and adapted to progressively compress in the direction of an impact and absorb at least a part of the impact force.

2. The impact absorption padding of claim 1, wherein the air pockets are formed from various thicknesses of plastic and rubber forming different parts of the air pocket.

3. The impact absorption padding of claim 1, wherein the air pockets include a pressure control valve adapted to allow air to escape at a different rate from other adjacent air pockets, thereby providing at least two different types of air pockets with different impact absorption mechanisms.

4. The impact absorption padding of claim 1, further comprising a layer of outer skin bonded directly to the top of the plurality of air pockets.

5. The impact absorption padding of claim 4, wherein the outer skin is a silicon material adapted to mark an area of impact that has exceeded a threshold.

6. The impact absorption padding of claim 5, wherein the mark is a deformation of the outer skin indicated by depressions and other visual cues.

7. The impact absorption padding of claim 4, wherein the outer skin is adapted to receive paints or decals depicting team colors and logos.

8. The impact absorption padding of claim 1, further comprising a base layer for providing structural support for the plurality of air pockets.

9. The impact absorption padding of claim 8, wherein the base layer is a molded plastic layer adapted to the shape of a contact sports helmet shell.

10. The impact absorption padding of claim 1, wherein the padding is adapted to be additionally placed on an inside of a contact sports helmet shell as an inner impact absorption padding.

11. The impact absorption padding of claim 10, wherein the padding adapted to be additionally placed on the inside of a contact sports helmet shell as an inner impact absorption padding is further adapted to receive foam padding to supplement the inner impact absorption padding.

12. The impact absorption padding of claim 1, wherein the contact sports helmet is adapted for football, hockey or lacrosse.

* * * * *